US006339422B1

(12) United States Patent
Kuwajima et al.

(10) Patent No.: US 6,339,422 B1
(45) Date of Patent: Jan. 15, 2002

(54) DISPLAY CONTROL CIRCUIT AND DISPLAY CONTROL METHOD

(75) Inventors: Hidenori Kuwajima, Yamatokoriyama; Toshio Matsumoto, Nara, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/181,243

(22) Filed: Oct. 28, 1998

(30) Foreign Application Priority Data

Oct. 28, 1997 (JP) ..... 9-295143

(51) Int. Cl.[7] ..... G09G 5/00; G09G 3/36
(52) U.S. Cl. ..... 345/204; 89/87; 89/213
(58) Field of Search ..... 345/89, 87, 99, 345/100, 211, 213, 147, 204

(56) References Cited

U.S. PATENT DOCUMENTS 4,998,100 A * 3/1991 Ishii ..... 345/89
5,534,883 A * 7/1996 Koh ..... 345/89
5,818,416 A * 10/1998 Kwang ..... 345/127
5,821,818 A * 10/1998 Idei et al. ..... 331/17

FOREIGN PATENT DOCUMENTS

JP 02120792 A 5/1990

* cited by examiner

*Primary Examiner*—Richard Hjerpe
*Assistant Examiner*—Duc Dinh
(74) *Attorney, Agent, or Firm*—David G. Conlin; William J. Daley, Jr.; Dike, Bronstein, Roberts and Cushman, Intellectual Property Practice Group, Edwards & Angell, LLP

(57) ABSTRACT

A display control circuit of the present invention includes: a clock generator for generating a first clock signal having a single frequency; a frequency divider for dividing the frequency of the first clock signal generated by the clock generator, thereby providing a second clock signal; a selection signal generation section for generating a selection signal upon which one of a binary display mode and a gray-scale display mode is selected; a selector for selecting one of the first clock signal and the second clock signal based on the selection signal; and a display circuit for performing one of the binary display mode and the gray-scale display mode using the selected clock signal.

9 Claims, 5 Drawing Sheets

DISPLAY CONTROL CIRCUIT AND DISPLAY CONTROL METHOD

BACKGROUND OF THE INVENTION

1. Field of the Invention

The present invention relates to a display control circuit and a display control method for use with a display system in an information processing apparatus (OA apparatus) such as a personal digital assistant and a portable computer, which uses an LCD (liquid crystal display) device.

2. Description of the Related Art

An LCD device has a small size and low power consumption, and therefore is typically used in an information processing apparatus such as a personal digital assistant and a portable computer. Among others, an STN (super-twisted nematic) reflection-type LCD device is used widely since it is less expensive than a TFT (thin film transistor) LCD device and still is capable of providing a relatively large capacity display (several hundreds×several hundreds pixels).

The primary display mode of the STN LCD device is a black and white binary display mode (hereinafter, referred to simply as a "binary display mode"). However, using the same binary-display LCD device, a gray-scale display can also be performed by modifying the signal application to the device.

Japanese Laid-open Publication No. 2-120792 discloses a frame modulation method (also called a "frame thinning method") which is typically employed for performing a gray-scale display in an STN LCD device. In this method, the amount of display data per pixel input to an LCD driver is the same as that in the binary display mode (one bit per pixel). However, unlike the binary display mode, a display data signal on a certain display data signal line is controlled for each "frame" (a period of time in which display data signals for one screen are sent to the LCD device), so as to realize a gray-scale display.

For example, in order to display white (or black) on a pixel for a certain period of time, a white (or black) signal is provided to the LCD driver via a corresponding display data signal line at a timing corresponding to the pixel position for a set of frames according to the period of time. In order to display a gray-scale level on the pixel for the period of time, either a white or black signal is provided to the LCD driver for each of the set of frames according to the period of time. The gray-scale level of the pixel for the period of time is defined by the frame number ratio between the white signal and the black signal which are sent to the LCD driver during the period of time.

In such a gray-scale display system employing the frame thinning method, specific timings of various control signals for driving the LCD driver can be the same as those in the binary display mode. However, in order to avoid display quality deterioration such as flicker, it is necessary to use a frame frequency which is different from that employed in the binary display mode.

The flicker in the STN LCD device is caused by interference between blinking of a fluorescent lamp (due to the supplied electric current alternating at the commercial power frequency) and changes in the brightness of the LCD. Since the frequency at which the brightness of the LCD changes is determined by the frame frequency, the appropriate selection of frame frequency is critical. Typically, the frame frequency is set to 70 Hz for the binary display mode. When the frame frequency is set to 70 Hz, flicker is substantially imperceivable either when the commercial power frequency is 50 Hz (as in eastern Japan) or when the commercial power frequency is 60 Hz (as in western Japan).

However, when the frame thinning method is employed with the frame frequency of 70 Hz, flicker becomes conspicuous, and the display quality considerably deteriorates. A higher frame frequency should be used for the gray-scale display based on the frame thinning method. While the appropriate frame frequency varies depending upon the characteristics of the particular LCD device, when the frame frequency is increased to about 140 Hz for such a gray-scale display, the gray-scale display can be performed with hardly any flicker.

When the system is intended to perform only one of the binary display and the gray-scale display (as is typical in a conventional display system), such a consideration of the frame frequency is not necessary for the LCD controller.

When a single display system is intended to be used for both the binary display and the gray-scale display, two different oscillators are conventionally provided for generating two different clock signals for the two different frame frequencies, or a single oscillator is provided for generating a single clock signal while performing both the gray-scale display and the binary display at the same frame frequency (e.g., 140 Hz).

As described above, the binary display and the gray-scale display have different optimal LCD frame frequencies (and thus different optimal operating clock frequencies for the LCD controller).

In addition, as described above, a system intended to perform both the binary display and the gray-scale display conventionally employs two different oscillators for obtaining two different oscillation frequencies so that the optimal frame frequency can be obtained both in the binary display and in the gray-scale display.

However, providing two different oscillators is disadvantageous in terms of circuit scale and cost.

The optimal frame frequency for the gray-scale display (e.g., 140 Hz) also may be used for the binary display, instead of providing two different frame frequencies. In such a case, although flicker does not occur in the binary display, the power consumption increases because of the high frame frequency of 140 Hz being used for the binary display, which requires only 70 Hz. The power consumption of the LCD device increases in proportion to the driving frame frequency. Moreover, an increase in the frame frequency leads to an increase in the LCD controller operating clock frequency and thus an increase in the power consumption of the LCD controller circuit.

SUMMARY OF THE INVENTION

According to one aspect of this invention, a display control circuit includes: a clock generator for generating a first clock signal having a single frequency; a frequency divider for dividing the frequency of the first clock signal generated by the clock generator, thereby providing a second clock signal; a selection signal generation section for generating a selection signal upon which one of a binary display mode and a gray-scale display mode is selected; a selector for selecting one of the first clock signal and the second clock signal based on the selection signal; and a display circuit for performing one of the binary display mode and the gray-scale display mode using the selected clock signal.

In one embodiment of the invention, the frequency divider further comprises a blocking section for blocking the frequency divider from receiving the first clock signal when the selector selects the first clock signal.

In one embodiment of the invention, the display control circuit further includes a voltage adjustment section for adjusting a display device driving voltage based on the selection signal when the display circuit variably controls a timing of a control signal output to a display device.

According to another aspect of this invention, a display control circuit includes: a clock generator for generating a first clock signal having a single frequency; a frequency multiplier for multiplying the frequency of the first clock signal generated by the clock generator, thereby providing a second clock signal; a selection signal generation section for generating a selection signal upon which one of a binary display mode and a gray-scale display mode is selected; a selector for selecting one of the first clock signal and the second clock signal based on the selection signal; and a display circuit for performing one of the binary display mode and the gray-scale display mode using the selected clock signal.

In one embodiment of the invention, the display control circuit further includes a voltage adjustment section for adjusting a display device driving voltage based on the selection signal when the display circuit variably controls a timing of a control signal output to a display device.

According to still another aspect of this invention, a display control method includes the steps of: generating a selection signal upon which one of a binary display mode and a gray-scale display mode is selected; selecting one of a first clock signal and a second clock signal obtained by dividing the frequency of the first clock signal based on the selection signal; and performing one of the binary display mode and the gray-scale display mode using the selected clock signal.

In one embodiment of the invention, the display control method further includes the step of generating one of a display setting voltage for the binary display mode and a display setting voltage for the gray-scale display mode based on the selection signal.

According to still another aspect of this invention, a display control method includes the steps of: generating a selection signal upon which one of a binary display and a gray-scale display is selected; selecting one of a first clock signal and a second clock signal obtained by multiplying the frequency of the first clock signal based on the selection signal; and performing one of the binary display mode and the gray-scale display mode using the selected clock signal.

In one embodiment of the invention, the display control method further includes the step of generating one of a display setting voltage for the binary display mode and a display setting voltage for the gray-scale display mode based on the selection signal.

Thus, the invention described herein makes possible the advantages of (1) providing a display control circuit for performing both a binary display and a gray-scale display without increasing the power consumption when performing the binary display; and (2) providing a display control method for the same.

These and other advantages of the present invention will become apparent to those skilled in the art upon reading and understanding the following detailed description with reference to the accompanying figures.

DESCRIPTION OF THE PREFERRED EMBODIMENTS

Figure 1:
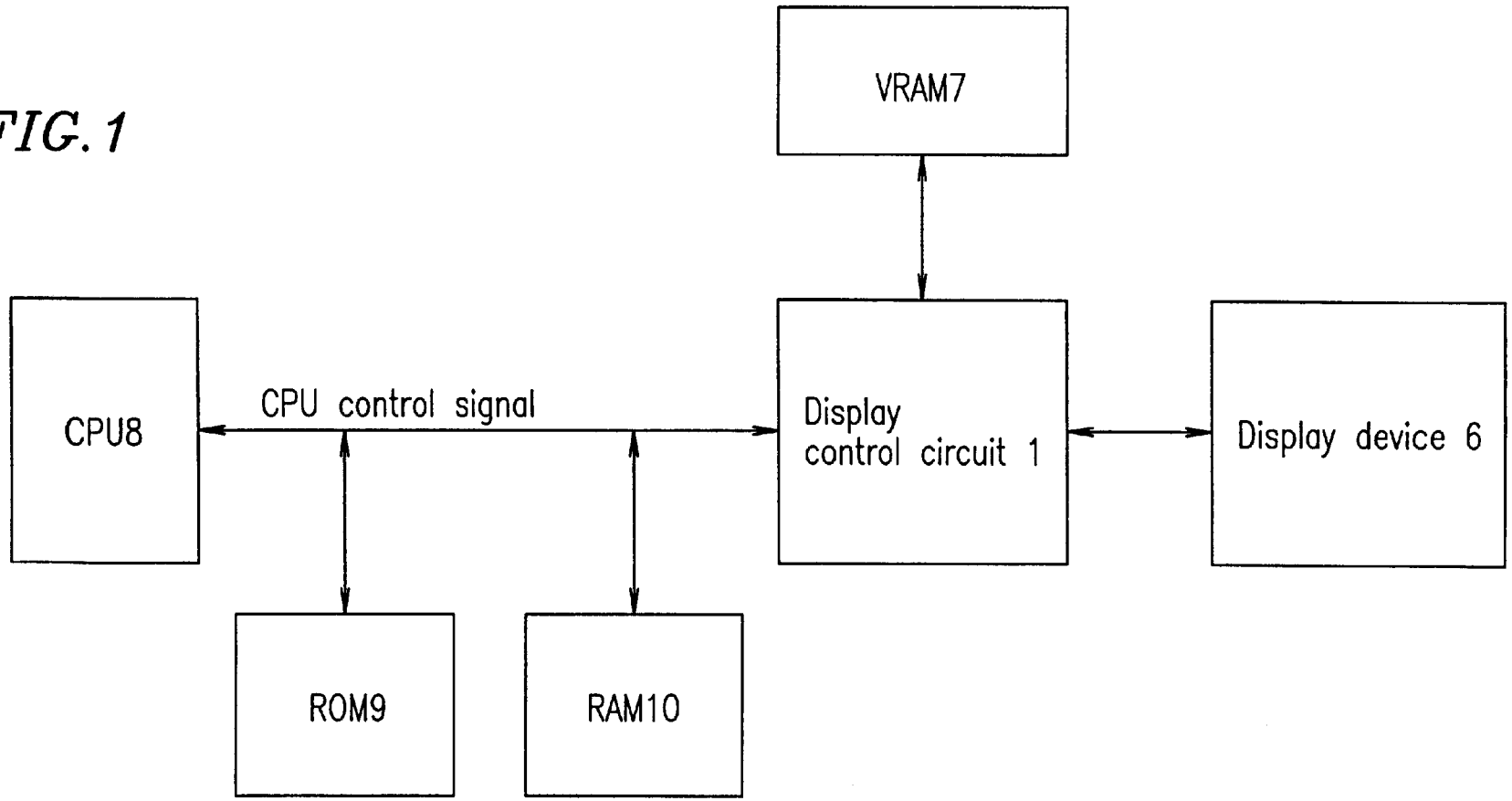
FIG. 1 is a block diagram illustrating a display system employing a display control circuit according to an example of the present invention.

FIG. 1 is a block diagram illustrating a display system employing a display control circuit according to the present invention. The display system includes a display control circuit 1, a CPU 8, a display memory 7 (hereinafter, referred to as a "VRAM"), a display device 6, a ROM 9 and a RAM 10.

The display control circuit 1 is connected to, and controlled by, the CPU 8. CPU control signals (e.g., an address bus signal, a data bus signal, a read signal and a write signal) are exchanged therebetween. The address bus and the data bus are also connected to the ROM 9 and the RAM 10.

Figure 2:
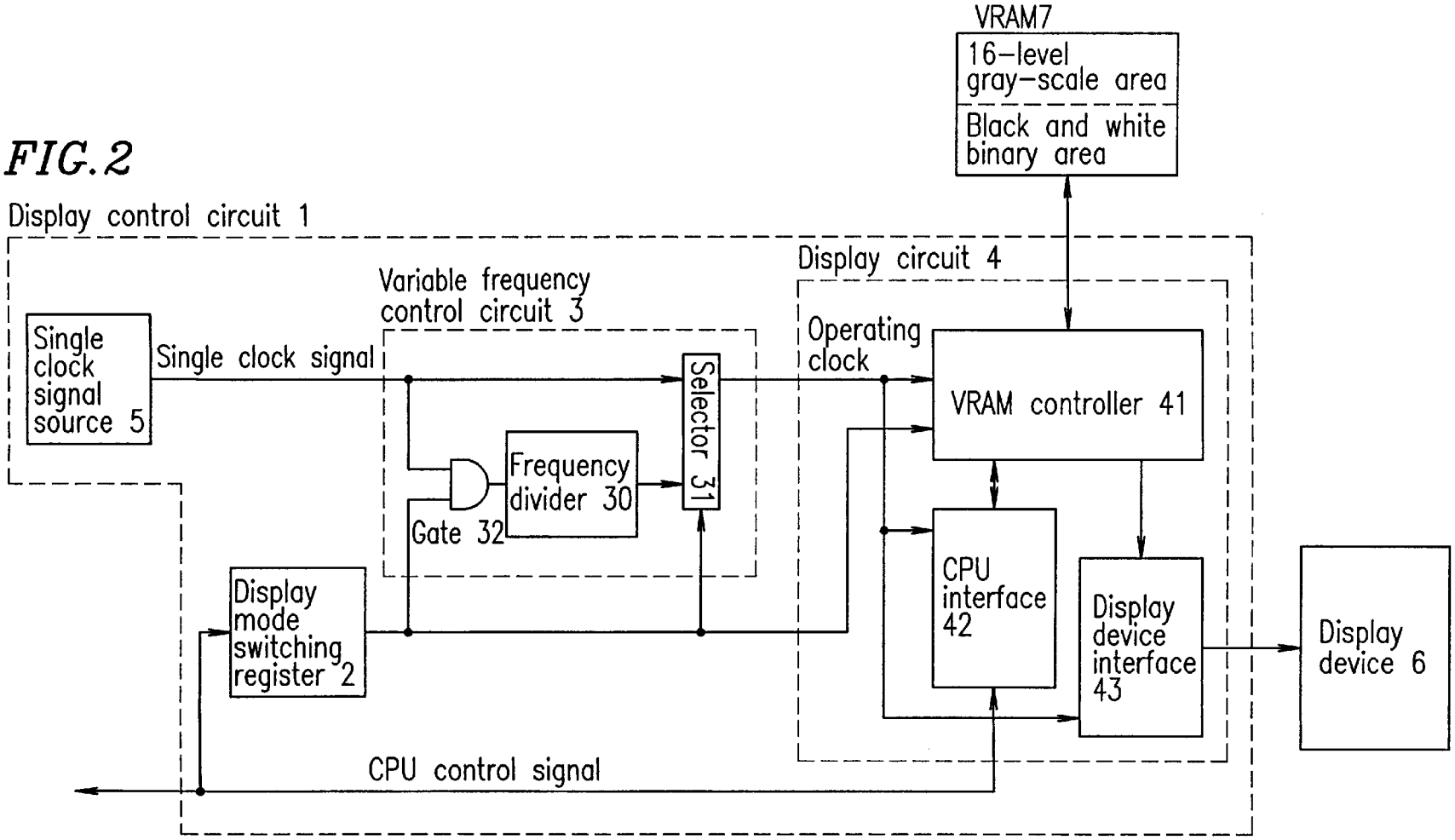
FIG. 2 is a block diagram illustrating the display control circuit employing a frequency divider according to an example of the present invention.

FIG. 2 is a block diagram illustrating the display control circuit 1 according to an example of the present invention. In this example, the display control circuit 1 employs a frequency divider.

Figure 3:
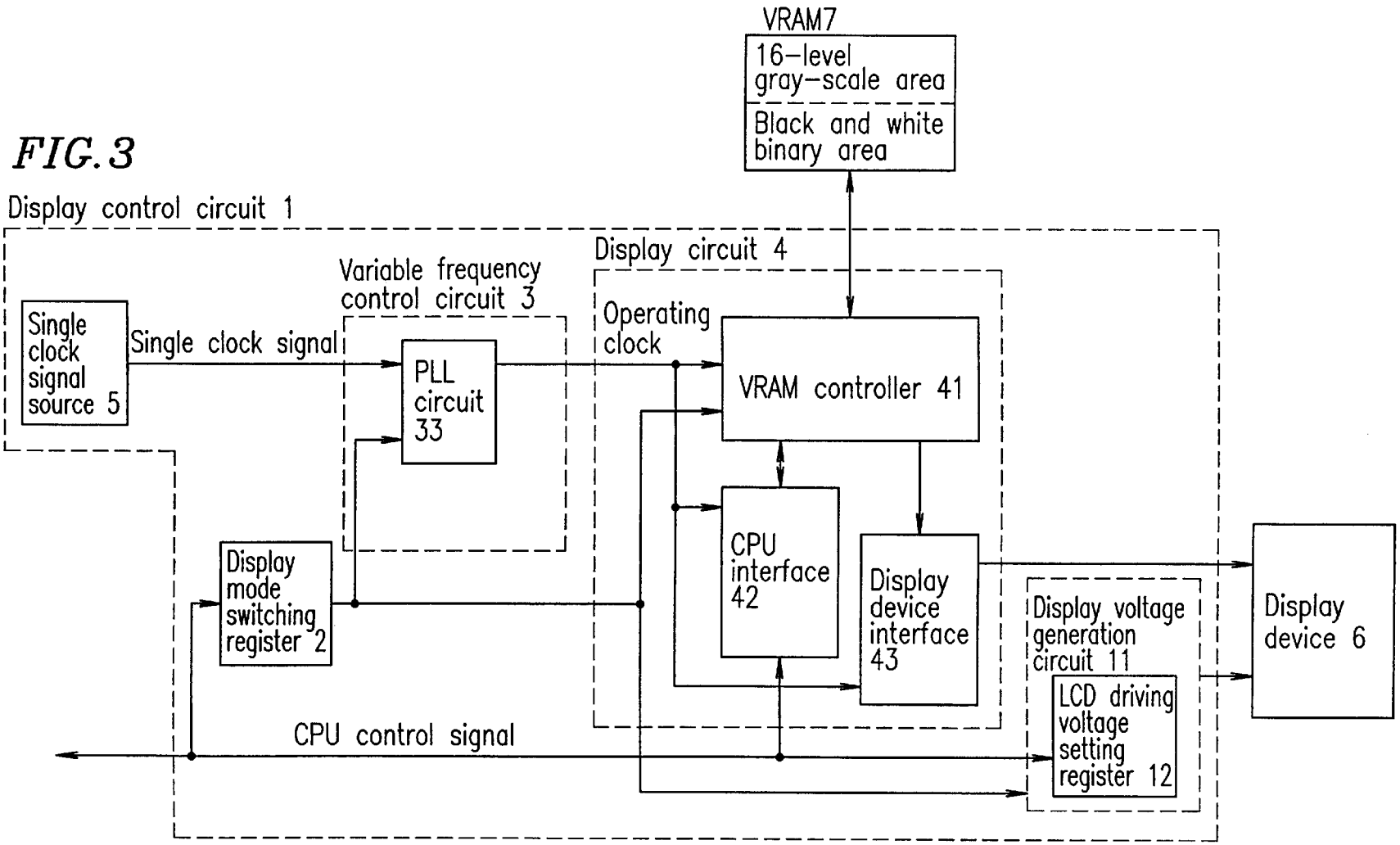
FIG. 3 is a block diagram illustrating the display control circuit employing a frequency multiplier according to an example of the present invention.

FIG. 3 is a block diagram illustrating a display control circuit 1 according to another example of the present invention. In this example, the display control circuit 1 employs a frequency multiplier instead of the frequency divider.

Referring to FIGS. 2 and 3, the display control circuit 1 includes a display mode switching register 2, a variable frequency control circuit 3, a display circuit 4. A single clock signal source 5 provided in the display control circuit 1 produces a clock signal having a single frequency. The single clock signal source 5 may be a ceramic oscillator, or the like, and it is assumed in the following examples of the present invention that the single clock signal source 5 does not have a complicated variable frequency function.

The display mode switching register 2 contains a value indicating whether the current display mode is the binary display mode or the gray-scale display mode. The value of the display mode switching register 2 is provided to the variable frequency control circuit 3 and the display circuit 4.

The variable frequency control circuit 3 has a function of varying a frequency, and may be a frequency divider, a frequency multiplier (e.g., a PLL circuit), or the like. The variable frequency control circuit 3 sets and outputs a frequency of an operating clock signal to be provided to the display circuit 4 based on the input from the display mode switching register 2.

The display circuit 4 includes a VRAM controller 41, a CPU interface 42 and a display device interface 43.

The VRAM controller 41 controls the timing to access the VRAM 7. The CPU interface 42 receives the CPU control signal provided by the CPU 8 and instructs the VRAM controller 41 to update the display data stored in the VRAM 7.

The display device interface 43 outputs to the display device 6 display control signals (e.g., display data, a display clock signal and a synchronization signal) conforming to the specification of the display device 6.

As described above, the display device 6 can perform both the binary display and the gray-scale display based on the frame thinning method. In the present invention, an STN LCD device is used as the display device 6. The display device 6 receives the control signals from the display device interface 43 in the display circuit 4.

The VRAM 7 is connected to the VRAM controller 41 in the display circuit 4, and a VRAM control signal is exchanged therebetween. The VRAM control signal is a signal for controlling a general-purpose memory and may include, for example, an address bus signal, a data bus signal and a chip selection signal. In the present invention, the VRAM control signal is separated from the CPU control signal (including an address bus signal) controlled by the CPU 8.

The VRAM 7 contains display data to be displayed on the display device 6, and is divided, by its address, into a gray-scale display data area and a binary display data area. Alternatively, the same memory area can be used for both the gray-scale display data and the binary display data.

The frequency of the single clock signal produced in the display control circuit 1 will now be described. Although it is assumed in the present invention that a 16-level gray-scale display is performed, it will be appreciated that the present invention can also be used with other gray-scale level displays (e.g., a 4-level gray-scale display).

When performing a binary display and a 16-level gray-scale display using an STN LCD device, the frame frequency is preferably set to 70 Hz for the binary display and to 140 Hz for the 16-level gray-scale display.

It is assumed in the following examples of the present invention that the STN LCD device 6 has a resolution of 320×240 pixels. Accordingly, in order to realize a frame frequency of 140 Hz for the 16-level gray-scale display, the display data transfer clock frequency is 140 Hz×320×240×= 10.752 MHz.

When the bit width (for a display data transfer clock input) of the LCD driver for driving the STN LCD device is 4 bits, a display clock signal having a frequency of at least 10.752 MHz/4=2.688 MHz is required.

Similarly, in order to realize a frame frequency of 70 Hz for the binary display, the display clock frequency of 1.344 MHz is required.

Thus, the oscillation frequency of the single clock signal source 5 (the frequency of the single clock signal) is a frequency obtained by multiplying or dividing (depending upon the specification of the variable frequency control circuit 3) the operating clock frequency provided to the display circuit 4.

The single clock frequency will now be described on the assumption that the STN LCD device has a display resolution of 320×240 pixels, and the LCD driver has a data input bit width of 4 bits for each clock.

EXAMPLE 1

Example 1 of the present invention will now be described in detail. Referring to FIG. 2, the variable frequency control circuit 3 of Example 1 includes a frequency divider 30 and a selector 31. The frequency division ratio of the variable frequency control circuit 3 is ½. The oscillation frequency of the single clock signal source 5 is set to 2.688 MHz.

The operation of the display circuit 4 performing the binary display will now be described. First, the CPU 8 sets a value in the display mode switching register 2 indicating the binary display mode via a CPU control signal. Based on this register value, the variable frequency control circuit 3 selects the clock signal whose frequency has been divided by the frequency divider 30 as the operating clock signal for the display circuit 4.

Thus, the frequency of the operating clock signal input to the display circuit 4 is 2.688 MHz/2=1.344 MHz.

The display device interface 43 uses the operating clock signal as the driving clock to generate the timing of the display control signal and output it to the display device 6. The display data of the display control signal is stored in the binary display data area of the VRAM 7, and the display device interface 43 outputs to the display device 6 the binary display data via the VRAM controller 41 based on the value stored in the display mode switching register 2 based on the display control signal.

The clock signal for the VRAM controller 41 and the CPU interface 42 in the display circuit 4 does not have to be the operating clock signal whose frequency has been divided, but may alternatively be the original clock signal from the single clock signal source 5 before being divided, or another clock signal having another frequency.

It is advantageous, however, in terms of power consumption to use the frequency-divided operating clock signal for the VRAM controller 41 and the CPU interface 42, as long as the resulting lower operation speed of the VRAM controller 41 and the CPU interface 42 does not substantially affect the processing speed of the entire display system.

In this way, the frame frequency of 70 Hz can be realized, while performing the binary display on the STN LCD device 6 without flicker for any commercial power frequency.

The operation of the display circuit 4 for performing the 16-level gray-scale display will now be described.

The CPU 8 sets a value in the display mode switching register 2 indicating the 16-level gray-scale display mode via a CPU control signal. Based on this register value, the variable frequency control circuit 3 selects the single clock signal via the selector 31 from the single clock signal source 5 as the operating clock signal for the display circuit 4.

Thus, the frequency of the operating clock signal input to the display circuit 4 is 2.688 MHz. In this display mode, since the clock signal output from the frequency divider 30 is not used, a gate 32 can be provided to block the clock signal from being input to the frequency divider 30, thereby saving the power consumed by the frequency divider 30.

The display device interface 43 uses the operating clock signal as the driving clock signal to generate the timing of the display signal for the gray-scale display based on the frame thinning method and output it to the display device 6. The display data of the display control signal is stored in the gray-scale display data area of the VRAM 7, and the display device interface 43 outputs to the display device 6 the 16-level gray-scale display data via the VRAM controller 41 based on the value stored in the display mode switching register 2 based on the display control signal.

In this way, the frame frequency of 140 Hz can be realized, while performing the 16-level gray-scale display on the STN LCD device 6 without flicker for any commercial power frequency.

As described above, in the present example, a low-frequency clock signal is provided through a frequency division operation performed internally, and the display circuit 4 is provided with the frequency-divided clock signal in the binary display mode or with the undivided single clock signal in the 16-level gray-scale display mode. In this way, it is possible to drive the LCD device with the lowest possible frame frequency (70 Hz in the binary display mode, and 140 Hz in the 16-level gray-scale display mode) for each display mode without causing flicker.

EXAMPLE 2

Example 2 of the present invention will now be described in detail. In Example 2, a frequency multiplier is used instead of the frequency divider in the variable frequency control circuit 3.

Referring to FIG. 3, the variable frequency control circuit 3 includes a frequency multiplier or a PLL circuit 33. In this preferred example, the multiplying factor of the PLL circuit 33 can be selected from ×1 and ×2.

The oscillation frequency of the single clock signal source 5 is set to 1.344 MHz, which can be used to realize 70 Hz (the frame frequency used in the binary display mode). The single clock signal is input to the PLL circuit 33.

The variable frequency control circuit 3 selects the multiplying factor of the PLL circuit 33 based on the value stored in the display mode switching register 2. When the value stored in the display mode switching register 2 indicates the binary display mode, the variable frequency control circuit 3 selects the multiplying factor ×1 (no multiplication), thereby outputting the clock signal having the frequency of 1.344 MHz to the display circuit 4 as the operating clock signal.

When the value stored in the display mode switching register 2 indicates the 16-level gray-scale display mode, the variable frequency control circuit 3 selects the multiplying factor ×2, thereby outputting the clock signal whose frequency has been doubled by the PLL circuit 33 to the display circuit 4 as the operating clock signal.

The display circuit 4 reads out the display data from the VRAM 7 based on the operating clock signal, and outputs the display control signal to the display device 6 in response to the display signal in the grayscale display mode based on the frame thinning method.

As described above, in the present example, a high-frequency clock signal is provided through a frequency multiplication operation performed internally, and the display circuit 4 is provided with the unmultiplied clock signal in the binary display mode or with the clock signal having a frequency which has been multiplied by the PLL circuit 33 in the 16-level gray-scale display mode. In this way, it is possible to drive the LCD device with the lowest possible frame frequency (70 Hz in the binary display mode, and 140 Hz in the 16-level grayscale display mode) for each display mode without causing flicker.

EXAMPLE 3

Example 3 of the present invention will now be described in detail.

In Examples 1 and 2 above, when the CPU 8 writes, via a CPU control signal, a value indicating the 16-level gray-scale display mode into the display mode switching register 2, which is currently indicating the binary display mode, the STN LCD device 6 is switched to the 16-level gray-scale display mode, and the frame frequency of the display control signal output to the display device 6 is automatically switched from 70 Hz to 140 Hz.

Typically, in order to obtain the optimal contrast in an STN LCD device, a higher voltage is required in the 16-level gray-scale display mode than in the binary display mode. Therefore, when the display mode is switched from the binary display mode to the 16-level gray-scale display mode without varying the LCD driving voltage, the contrast may decrease and the display density across the screen may be reduced.

Thus, when the display mode is switched from the binary display mode to the 16-level gray-scale display mode after obtaining the optimal contrast in the binary display mode, the display density may be lower than the optimal level. Conversely, when the display mode is switched from the 16-level gray-scale display mode to the binary display mode after obtaining the optimal contrast in the 16-level gray-scale display mode, the display density may be higher than the optimal level.

In view of the above phenomena, according to Example 3, the following control is performed, while the respective optimal display density values for the binary display mode and for the 16-level gray-scale display mode are previously recorded in a memory (e.g., the RAM 10 illustrated in FIG. 1).

Figure 4A:
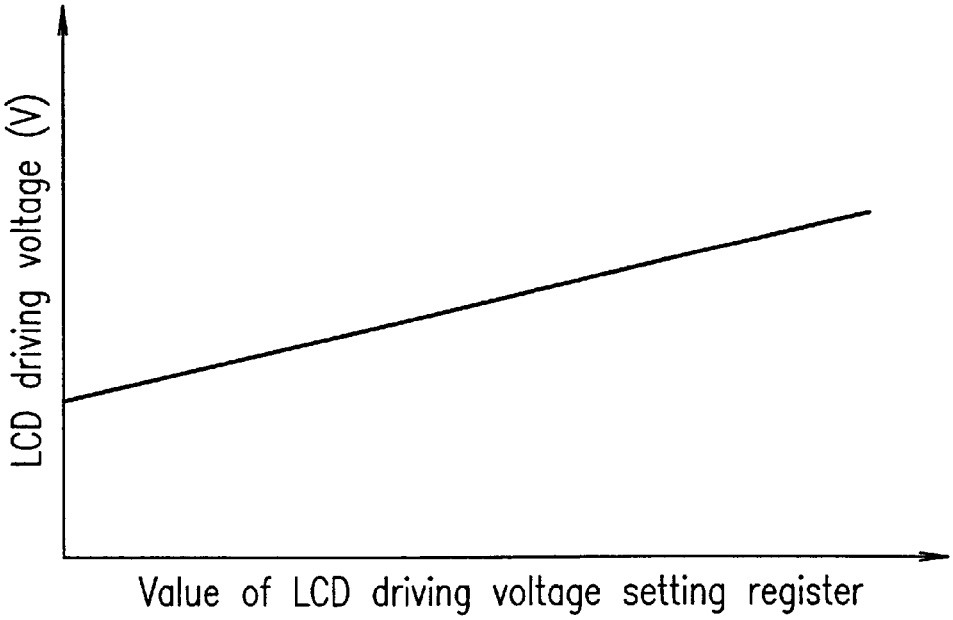
FIG. 4A is a graph illustrating the relationship between an LCD driving voltage and a value of an LCD driving voltage setting register.

Referring to FIG. 3, a display voltage generation circuit 11 provides an LCD driving voltage to the display device 6. The voltage can be varied based on a control signal from the CPU 8. The display voltage generation circuit 11 includes an LCD driving voltage setting register 12 storing a value upon which the LCD driving voltage is appropriately determined. FIG. 4A shows the relationship between the value of the LCD driving voltage setting register 12 and the LCD driving voltage.

Each time the display mode, which is indicated by the display mode switching register 2, is switched, one of display density setting values stored in a memory is selected based on the new display mode, and is set in the LCD driving voltage setting register 12. Initially, a predetermined initial value for an appropriate display density is set in the LCD driving voltage setting register 12.

By such a control, the optimal contrast is always obtained both in the binary display mode and in the 16-level gray-scale display mode. Thus, a user of a display apparatus incorporating this display system does not have to manually adjust the contrast each time the display mode is switched between the binary display mode and the 16-level gray-scale display mode, thereby facilitating the use of the apparatus.

A display control circuit according to a variation of the present example will now be described. As illustrated in FIG. 3, The display voltage generation circuit 11 receives the display mode switching data from the display mode switching register 2. The display voltage generation circuit 11 is the LCD driving power source of the display device 6.

Figure 4B:
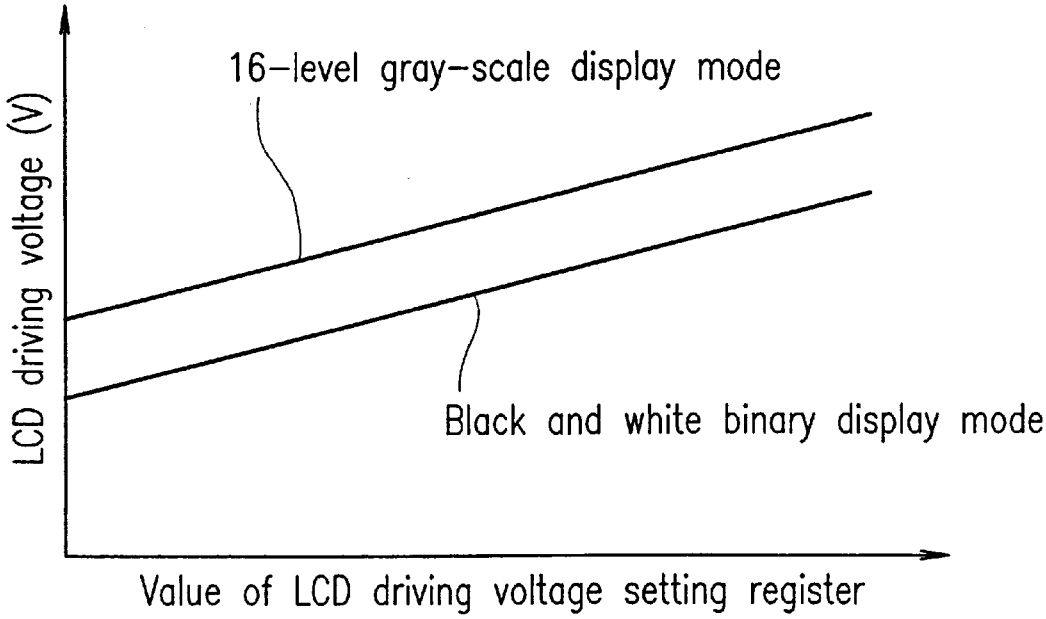
FIG. 4B is a graph illustrating the relationship between an LCD driving voltage and a value of an LCD driving voltage setting register in a gray-scale display mode and a black and white display mode, respectively.

The display voltage generation circuit 11 changes the relationship between the value of the LCD driving voltage setting register 12 and the LCD driving voltage, as shown in FIG. 4B, based on the value stored in the display mode switching register 2.

In other words, the display voltage generation circuit 11, according to the variation of the present example, has two different relationships between the value of the LCD driving voltage setting register 12 and the LCD driving voltage which is switched from one to another based on the data input to the display voltage generation circuit 11. When the value stored in the display mode switching register 2 is used as the input data, the LCD driving voltage varies automatically as the value of the display mode switching register 2 changes, thereby automatically realizing the optimal contrast both in the binary display mode and in the 16-level gray-scale display mode.

EXAMPLE 4

Figure 5:
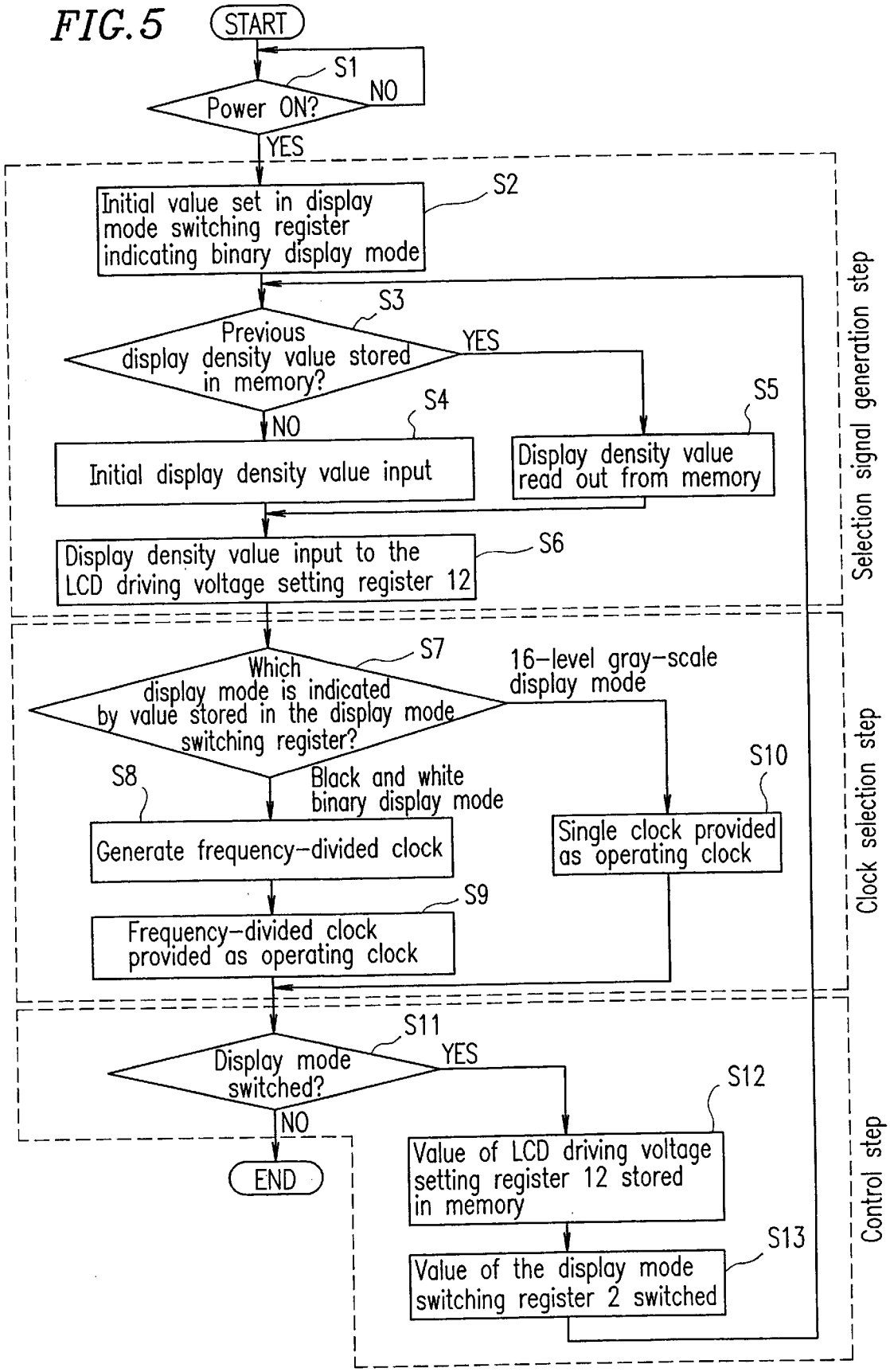
FIG. 5 is a flow chart illustrating a process for switching a display mode.

Example 4 of the present invention will now be described in detail with reference to FIG. 5. The present example is directed to a display control method.

In step S1, a determination is made as to whether the power of the display system using the display control circuit 1 is turned on.

If the power is turned on, an initial value is stored in the display mode switching register 2 in step S2. Although the initial value is a value indicating the binary display mode in this example, the initial value may alternatively be a value indicating the 16-level gray-scale display mode.

In step S3, a determination is made as to whether any display density data has been set in a memory (e.g., the RAM 10). Immediately after resetting and initializing the display system, for example, the 16-level gray-scale display mode may have not been selected yet (e.g., when the binary display mode is selected as the default mode).

If the determination is negative in step S3 (where a display density adjustment has not been performed), an initial display density value is input in step S4, which is then input to the LCD driving voltage setting register 12 in step S6. The initial value may alternatively be input directly to the LCD driving voltage setting register 12.

If the determination is affirmative in step S3 (where a display density value has already been input), the display density value is read out of the memory (step S5) and input to the LCD driving voltage setting register 12 in step S6.

In step S7, the current display mode is determined based on the value stored in the display mode switching register 2.

In the present example, if the current display mode is the binary display mode, the original frequency of the single clock signal is divided in step S8, and the frequency-divided clock signal is provided as the operating clock signal of the display circuit 4 in step S9. If the current display mode is the 16-level gray-scale display mode, the single clock signal having the original frequency is provided as the operating clock signal of the display circuit 4 in step S10.

In a variation of the present example, if the current display mode is the binary display mode, the single clock signal having the original frequency is provided as the operating clock signal of the display circuit 4. If the current display mode is the 16-level gray-scale display mode, the original frequency of the single clock signal is multiplied, and the frequencymultiplied clock signal is provided as the operating clock signal of the display circuit 4.

In step S11, a determination is made as to whether the display mode is switched between the binary display mode and the 16-level gray-scale display mode.

If the display mode is not switched, the display density switching process is terminated. If the display mode is switched from one to another, the current value of the LCD driving voltage setting register 12 is stored in a memory in step S12, the value of the display mode switching register 2 is switched to indicated the new display mode in step S13, and the process returns to step S3.

As described above, in a display control circuit of the present invention, the display circuit 4 is provided with the frequency-divided clock signal in the binary display mode or with the undivided single clock signal in the 16-level gray-scale display mode. In this way, it is possible to drive the LCD device with the lowest possible frame frequency (70 Hz in the binary display mode, and 140 Hz in the 16-level gray-scale display mode) for each display mode without causing flicker.

Thus, it is possible to perform both the binary display and the gray-scale display without increasing the power consumption when performing the binary display.

In another display control circuit of the present invention, the gate 32 is provided to block the clock signal from being input to the frequency divider 30 in the 16-level gray-scale display mode (where the clock signal output from the frequency divider 30 is not used), thereby saving the power consumed by the frequency divider 30.

In still another display control circuit of the present invention, the display circuit 4 is provided with the unmultiplied clock signal in the binary display mode or with the clock signal having a frequency which has been multiplied by the PLL circuit 33 in the 16-level gray-scale display mode. In this way, it is possible to drive the LCD device with the lowest possible frame frequency (70 Hz in the binary display mode, and 140 Hz in the 16-level gray-scale display mode) for each display mode without causing flicker.

Thus, it is possible to perform both the binary display and the gray-scale display without increasing the power consumption when performing the binary display.

In the display control method of the present invention, the optimal contrast is always obtained both in the binary display mode and in the 16-level gray-scale display mode. Thus, a user of a display apparatus incorporating the display system of the present invention does not have to manually adjust the contrast each time the display mode is switched between the binary display mode and the 16-level gray-scale display mode, thereby facilitating the use of the apparatus.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A display control circuit, comprising:

a clock generator for generating a first clock signal having a single frequency;

a frequency divider for dividing the frequency of the first clock signal generated by the clock generator, thereby providing a second clock signal;

a selection signal generation section for generating a selection signal upon which one of a binary display mode and a gray-scale display mode is selected;

a selector for selecting one of the first clock signal and the second clock signal based on the selection signal; and a display circuit for performing one of the binary display mode and the gray-scale display mode using the selected clock signal.

2. A display control circuit according to claim 1, wherein the frequency divider further comprises a blocking section for blocking the frequency divider from receiving the first clock signal when the selector selects the first clock signal.

3. A display control circuit according to claim 1, further comprising a voltage adjustment section for adjusting a display device driving voltage based on the selection signal when the display circuit variably controls a timing of a control signal output to a display device.

4. A display control circuit, comprising:

a clock generator for generating a first clock signal having a single frequency;

a frequency multiplier for multiplying the frequency of the first clock signal generated by the clock generator, thereby providing a second clock signal;

a selection signal generation section for generating a selection signal upon which one of a binary display mode and a gray-scale display mode is selected;

a selector for selecting one of the first clock signal and the second clock signal based on the selection signal; and a display circuit for performing one of the binary display mode and the gray-scale display mode using the selected clock signal.

5. A display control circuit according to claim 4, further comprising a voltage adjustment section for adjusting a display device driving voltage based on the selection signal when the display circuit variably controls a timing of a control signal output to a display device.

6. A display control method, comprising the steps of:

generating a selection signal upon which one of a binary display mode and a gray-scale display mode is selected;

selecting one of a first clock signal and a second clock signal obtained by dividing the frequency of the first clock signal based on the selection signal; and performing one of the binary display mode and the gray-scale display mode using the selected clock signal.

7. A display control method according to claim 6, further comprising the step of generating one of a display setting voltage for the binary display mode and a display setting voltage for the gray-scale display mode based on the selection signal.

8. A display control method, comprising the steps of:

generating a selection signal upon which one of a binary display and a gray-scale display is selected;

selecting one of a first clock signal and a second clock signal obtained by multiplying the frequency of the first clock signal based on the selection signal; and performing one of the binary display mode and the gray-scale display mode using the selected clock signal.

9. A display control method according to claim 8, further comprising the step of generating one of a display setting voltage for the binary display mode and a display setting voltage for the gray-scale display mode based on the selection signal.

* * * * *